United States Patent [19]

Griebel, III et al.

[11] Patent Number: 4,612,649

[45] Date of Patent: Sep. 16, 1986

[54] PROCESS FOR REFINING METAL

[75] Inventors: Arthur H. Griebel, III, Kokomo; Richard A. Foster, Russiaville, both of Ind.

[73] Assignee: Cabot Corporation, Boston, Mass.

[21] Appl. No.: 550,348

[22] Filed: Nov. 10, 1983

[51] Int. Cl.[4] ..... H05B 3/60

[52] U.S. Cl. ..... 373/45; 164/515

[58] Field of Search ..... 164/508, 509, 515; 373/42, 44, 45, 48, 54, 47, 67, 70, 72, 108

[56] References Cited

U.S. PATENT DOCUMENTS

| | | | |
|---|---|---|---|
| 3,608,618 | 9/1971 | Maskall | 164/515 |
| 3,765,471 | 10/1973 | Paton et al. | 373/47 |
| 3,768,543 | 10/1973 | Kolisnyk | 164/509 |
| 3,915,217 | 10/1975 | Ellebrecht et al. | 373/45 |
| 4,055,215 | 10/1977 | Ramacciotti et al. | 373/44 |
| 4,108,235 | 8/1978 | Paton et al. | 164/515 |
| 4,145,563 | 3/1979 | Rabinovich et al. | 373/45 |
| 4,185,682 | 1/1980 | Ksendzyk et al. | 164/515 |
| 4,204,082 | 5/1980 | Stenkvist | 373/72 |
| 4,336,411 | 6/1982 | Hanas et al. | 373/108 |

FOREIGN PATENT DOCUMENTS

| | | | |
|---|---|---|---|
| 1483646 | 9/1969 | Fed. Rep. of Germany . | |
| 1173339 | 12/1969 | United Kingdom | 373/54 |
| 1391258 | 4/1975 | United Kingdom | 164/515 |

*Primary Examiner*—Roy N. Envall, Jr.
*Assistant Examiner*—Gregory P. Thompson
*Attorney, Agent, or Firm*—R. Steven Linne; Jack Schuman

[57] ABSTRACT

A process for refining metal in a crucible containing a layer of molten slag, wherein molten metal passes downwardly through the slag and resolidifies as an ingot thereunder. The slag is kept molten by passing electrical current through the slag layer and between a first electrode and a second electrode. The second electrode has liquid or gas cooling means as an integral part thereof. Current is passed between the first electrode and the second electrode through at least one electrically conductive member interposed between the slag and the second electrode. The electrically conductive member has a melting temperature above the melting temperature and below the bulk temperature of the slag. A portion of the surface of the electrically conductive member that is in contact with the slag has a temperature above the freezing temperature of the slag. The first electrode may be a consumable electrode which is partially immersed in the layer of molten slag such that it gradually melts, and drops of metal move downwardly therefrom. The second electrode is usually the crucible but may be a non-consumable electrode which is partially immersed in the layer of molten slag.

8 Claims, 1 Drawing Figure

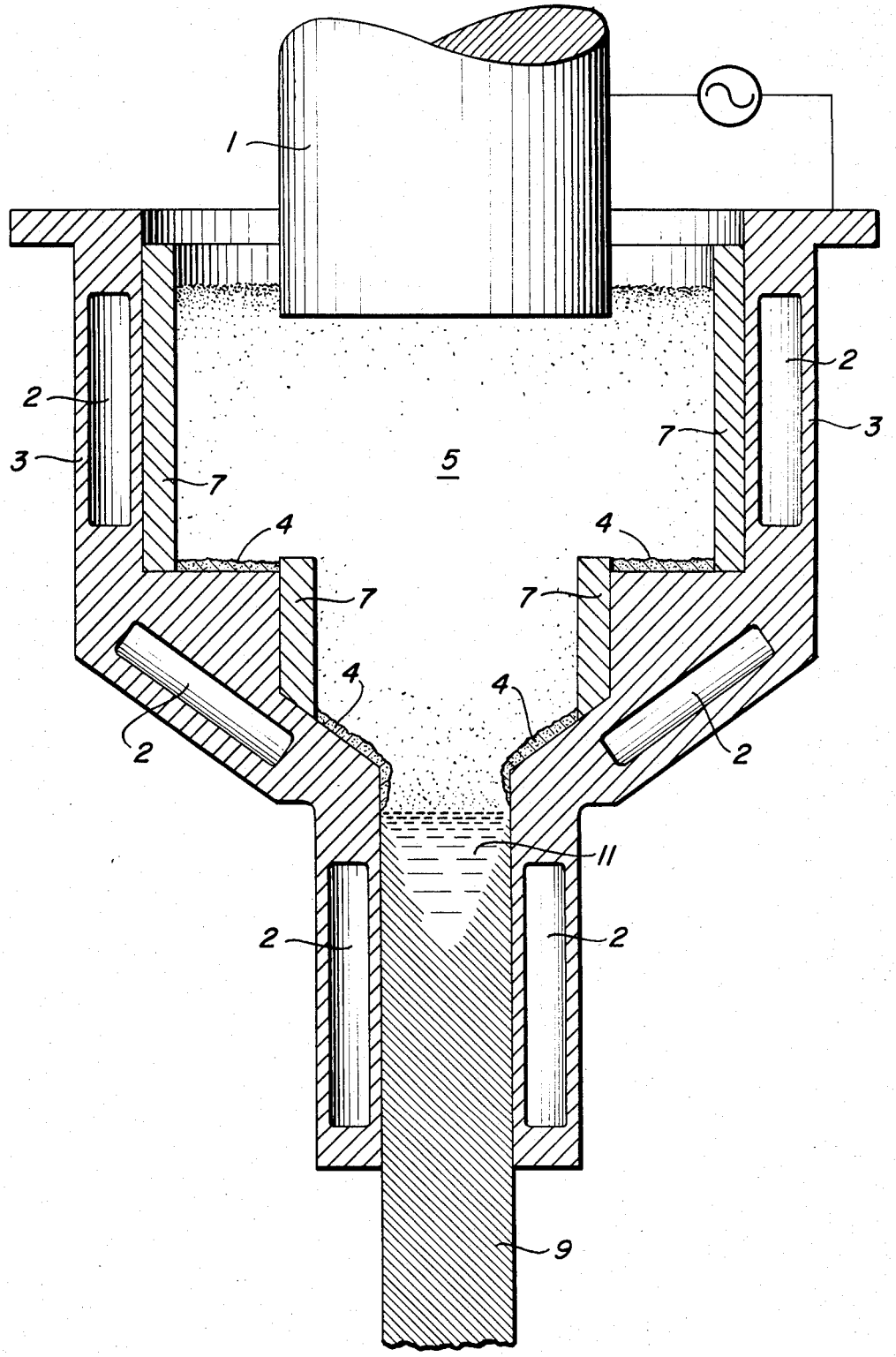
1
2
3
7
5
4
11
9

PROCESS FOR REFINING METAL

FIELD OF THE INVENTION

The present invention relates to a process for refining metal.

BACKGROUND OF THE INVENTION

Electroslag remelting is a secondary melting or refining process. Primary production ingots, known as consumable electrodes, are remelted and allowed to resolidify under more exactly controlled conditions than can be achieved during primary melting to improve their grain structure and to remove inclusions and inclusion-forming impurities. Remelting is achieved by resistance heating, with the electric current passing between the consumable electrode and a second electrode. The consumable electrode is partially immersed in a layer of slag, in which Joule heat for melting is generated. A pool of molten metal forms below the slag. The slag provides a path for the current. It also removes inclusions and inclusion-forming impurities from the melt.

The electric current is conventionally passed through the slag between the consumable electrode and the ingot. Such a procedure works very well in those instances where the ingot being formed has a cross section which is substantially the same size or larger than the cross section of the electrode(s) being melted. Such a procedure is undesirable in those instances where the cross section of the ingot being formed is smaller than the cross section of the electrode(s) being melted, such as in those instances where the ingot being formed is a bar. Ingots of smaller cross sections would necessitate frequent cutting. Cutting interrupts the current path, necessitating current removal by sliding contacts against the ingot. Sliding contacts are troublesome in that the ingots being formed are often neither smooth nor clean.

A current path which includes the ingot is also susceptible to another problem in those instances where the ingot being formed is smaller than the electrode being melted. The high current required to melt the consumable electrode could resistively heat the ingot and retard its solidification.

A need to establish an alternative current path existed. Experiments were conducted with the electric current being passed through the slag between the consumable electrode and the crucible. This resulted in instability in the operation of the furnace and damage to the crucible. It was hypothesized that a layer of slag froze adjacent to the crucible wall and that this layer of slag precipitated arcing thereacross. The crucible was water-cooled.

SUMMARY OF THE INVENTION

The present invention provides a current path which eliminates the arcing that occurs when electric current is passed through a slag between a consumable electrode and a second electrode having cooling means as an integral part thereof. It also provides a current path which eliminates the arcing that occurs when electric current is passed through a slag between two non-consumable electrodes, at least one of which has cooling means as an integral part thereof, such as in those situations wherein molten metal is poured through a slag. The arcing due to passing the electric current through the slag and between the electrodes is eliminated by passing the electric current through at least one electrically conductive member interposed between the slag and the cooled electrode. The electrically conductive member has a melting temperature above the melting temperature but below the bulk temperature of the slag. Thus, the member must be cooled somewhat to prevent its melting by the hot slag. For purposes of this application, bulk temperature of the slag is that temperature away from the walls of the crucible recognizing the fact that there are temperature gradients across the slag due to the loss of heat through the cooled crucible walls.

Electroslag remelting process are disclosed in many references, including U.S. Pat. Nos. 4,108,235 and 4,145,563. U.S. Pat. Nos. 4,108,235 and 4,145,563 do not disclose the current path of the present invention. The current path of U.S. Pat. No. 4,108,235 is between the consumable electrode, the crucible and a mandrel used to cast hollow ingots. That for U.S. Pat. No. 4,145,563 can include a crucible liner. The crucible liner is, however, electrically insulated from the crucible.

Processes for refining metal which is already molten are also disclosed in many references. These references include West German Pat. No. 1,482,646. As with the references discussed in the preceding paragraph, Pat. No. 1,483,646 does not disclose the current path of the present invention. It discusses a shell 13 of solidified slag which electrically insulates the slag from the crucible. The electrically conductive members of the present invention preclude such insulation.

It is, accordingly, an object of the present invention to provide a metal refining process characterized by the use of an improved current path.

The foregoing and other objects of the present invention will be best understood from the following description, reference being made to the accompanying drawing, wherein:

BRIEF DESCRIPTION OF THE DRAWING

The FIGURE is a schematic vertical cross-sectional representation of the elements forming the current path of the present invention.

DESCRIPTION OF THE PREFERRED EMBODIMENT

The present invention provides a process for refining metal in a cylindrical crucible containing a layer of molten slag, wherein molten metal passes downwardly through the slag and resolidifies as an ingot thereunder. The slag is kept molten by passing electrical current through the slag layer and between a first electrode and a second electrode. The second electrode has liquid or gas cooling means as an integral part thereof such as, for example, internal water passages. It is usually formed of copper or a copper alloy. Current is passed between the first electrode and the second electrode through at least one electrically conductive member interposed between the slag and the second electrode. The first electrode may be a consumable electrode which is partially immersed in the layer of molten slag such that it gradually melts, and drops of metal move downwardly therefrom. The second electrode is generally the crucible but may be a non-consumable electrode which is partially immersed in the layer of molten slag. The source of current may be either direct current or alternating current, although alternating current is preferred.

The electrically conductive members have a melting temperature above the melting temperature and below the bulk temperature of the slag. The cooled surface of the second electrode protects them from melting. The shape, thickness and thermal conductivity of the members are such that a portion of their surface (be it solid or liquid) that is in contact with the slag has a temperature above the freezing temperature of the slag. A member having a higher thermal conductivity will generally need to be thicker than a similarly shaped member having a lower thermal conductivity. Metals such as steel and nickel-base alloys are exemplary materials from which the members may be formed. The members usually have the shape of a ring. They can be interposed between the slag and the second electrode by any of those means known to those skilled in the art. Force fitting is one particular means for interposing the members.

A schematic representation of elements forming a current path in accordance with the present invention is shown in the FIGURE. Current is passed between consumable electrode 1 and crucible 3 through slag layer 5 and electrically conductive members 7. Although only one electrically conductive member would generally be used, more than one can be present as shown in the FIGURE. The electrically conductive member can, as shown, be made to fit the largest internal diameter of the crucible or be made to be placed within a recess in the crubible. Also shown are water passages 2, frozen slag 4 ingot 9 and molten metal pool 11.

The following examples are illustrative of several aspsects of the invention.

An attempt to pass current directly between a consumable electrode and a crucible, through a layer of slag, reslted in damage to the crucible. The trial was conducted under normal conditions and at normal current (1900 amperes) and voltage levels for a laboratory electroslag remelting furnace. The consumable electrode which was nickel-base alloy was 3.5 inches ($88.9\times10^{-3}$ meters) in diameter. The resulting ingot was 1 inch ($25.4\times10^{-3}$ meters) in diameter. The inside diameter of the top of the crucible was 5.25 inches ($133.4\times10^{-3}$ meters). The crucible was inspected before the trial and was found to have no defects and only a few blemishes. An inspection after the trial showed the crucible to be severely pitted with what appeared to be arc scars. The pits typically ranged in depth from 1/64 inch ($4\times10^{-4}$ meters) to 1/16 inch ($1.6\times10^{-3}$ meters). The trial lasted only ten minutes. If a pit were to penetrate the crucible wall, the inrush of water to the molten slag would cause an explosion. Damage to the crucible was characterized as being sufficient to prevent further trials with this current path.

The current path of the present invention was tried under much the same conditions as the trial reported in the preceding paragraph. A steel ring was machined to fit the largest internal diameter of a crucible and so fitted therein.

The results of the trial were most favorable. Neither the crucible nor the steel ring suffered any damage.

Forty-one additional trials were conducted using steel rings and nickel or cobalt base alloys as the consumable electrodes. The crucible was never damaged in these trials. The steel liner was replaced several times due to its eventual warping from the heat.

An additional trial was run with a nickel-base alloy ring machined to fit tightly within a recess in a crucible. This trial was run at 2200 amperes and 31 volts.

The crucible was inspected after the trial and was found to be free of any damage. There were no arc scars or pits nor any erosion of the crucible. The ring had experienced some melting around its top but this did not affect its functioning. It was subsequently reused.

It will be apparent to those skilled in the art that the novel principles of the invention disclosed herein, in connection with specific examples thereof, will suggest various other modifications and applications of the same. It is accordingly, desired that in construing the breadth of the appended claims, they shall not be limited to the specific examples of the invention described herein.

We claim:

1. In a process for electroslag refining metal in a crucible containing a layer of molten slag, wherein molten metal passes downwardly through said slag and resolidifies as an ingot thereunder and wherein said slag is kept molten by passing electrical current through said slag layer and between a first metallic electrode and a second metallic electrode, said second electrode being other than the resolidified ingot and having cooling means as an integral part thereof, the improvement conprising the steps of providing at least one electrically conductive member attached to said second electrode and submerged in said molten slag then passing substantially all of said electrical current between said first electrode and said second electrode on a path through said at least one electrically conductive member interposed between said slag and only a portion of said second electrode, said electrically conductive member having a melting temperature above the melting temperature but below the bulk temperature of said slag, and the portion of the surface of said electrically conductive member that is in contact with said slag having a temperature above the freezing temperature of said slag due to said member's thickness and thermal conductivity, thereby preventing the formation of a frozen slag layer thereon and arcing therethrough while avoiding passing current through said resolidified ingot.

2. The process according to claim 1, wherein said electrically conductive member is steel.

3. The process according to claim 1, wherein said electrically conductive member is a nickel-base alloy.

4. The process according to claim 1, wherein said first electrode is a consumable electrode which is partially immersed in slag such that it gradually melts, and drops of metal move downwardly therefrom.

5. The process according to claim 4 wherein the cross section of said ingot is made smaller than the cross section of said consumable electrode by a ratio of at least 1 to 3.5 by providing a crucible having an upper part with a large internal diameter for holding said consumable electrode partially immersed in said slag and having a lower part of smaller diameter for forming said ingot.

6. The process according to claim 5, wherein said electrically conductive member has the shape of a ring and is attached to said crucible.

7. The process according to claim 6 wherein said second electrode is said crucible and wherein said ring fits within a recess in the lower part of said crucible located just above the resolidified ingot.

8. An improved process for the electroslag refining of metal of the type in which electrical heating current is passed along a path through a slag layer between a metallic consumable electrode partially immersed in said slag and a bottomless, water cooled, cylindrical, copper crucible which holds said slag in its upper part and releasably holds a resolidified ingot in its lower part, said lower part being of smaller diameter than said upper part by a ratio of at least 1 to 3.5, in order to melt said slag and said electrode so that molten metal passes downwardly through said slag to form said resolidified ingot; which ingot may then be withdrawn, wherein the improvement comprises the steps of providing a ring-shaped, electrically conductive member having a melting temperature above the freezing temperature, but below the bulk temperature, of said slag;

fitting said member into said upper part of said crucible but submerged in said slag;

passing substantially all of said electric heating current through said ring-shaped, electrically conductive member interposed between a portion of said slag and the portion of said crucible which is located adjacent the area where said upper part and said lower part join; and controlling the temperature of the surface of said member which is in contact with the hot slag, by selecting the shape, thickness, and thermal conductivity of said member, so that said temperature is maintained above the freezing temperature of said slag, thereby providing a continuous path for said current through entirely said slag to said crucible without passing through said resolidified ingot.

* * * * *